United States Patent [19]

Werner et al.

[11] Patent Number: 4,520,643

[45] Date of Patent: Jun. 4, 1985

[54] ASSEMBLY FOR BLOWING OUT AND SPRAYING DIES IN FORGING PRESSES

[75] Inventors: Eberhard Werner; Friedrich Willim, both of Leverkusen, Fed. Rep. of Germany

[73] Assignee: Eumuco Aktiengesellschaft Für Maschinenbau, Fed. Rep. of Germany

[21] Appl. No.: 519,647

[22] Filed: Aug. 2, 1983

[30] Foreign Application Priority Data

Aug. 13, 1982 [DE] Fed. Rep. of Germany ..... 3230095

[51] Int. Cl.[3] ..... B21C 43/00; B21C 9/00

[52] U.S. Cl. ..... 72/39; 72/45

[58] Field of Search ..... 72/39, 41, 43, 44, 45; 164/72, 158, 267; 134/143

[56] References Cited

U.S. PATENT DOCUMENTS 3,633,651 1/1972 Ruhlandt ..... 164/267

FOREIGN PATENT DOCUMENTS 749010 5/1956 United Kingdom ..... 72/45
649497 2/1979 U.S.S.R. ..... 72/45
727301 4/1980 U.S.S.R. ..... 72/45

*Primary Examiner*—E. Michael Combs

*Attorney, Agent, or Firm*—Neil F. Markva

[57] ABSTRACT

The assembly for blowing out and spraying dies in a forging press is particularly adapted both to automatically operating and hand operated drop-forging presses. The automatically operating drop forging presses have workpiece transport effected by a walking beam transport system. The blowing and spraying assembly comprises arms having nozzles disposed at the end thereof to be guided into the mold area of the forging press in a timed sequence while avoiding the movement of the press plunger and walking beam transport system when it is being used. The blowing and spraying assembly comprises a carrier means hinged to a four-bar linkage arrangement which has two levers and a carrier member. In a specific embodiment, the ends of the two levers facing away from the carrier member are pivotably mounted to a housing. The housing constitutes a carrier support means secured to the stator of the forging press. One of the two levers is a drive lever used to move the carrier member and thus the nozzle means into and out of the mold area within the pressing zone of the forging press. The blowing and spraying assembly of the present invention is designed to permit universal use in both automated drop-forging presses and in hand operated drop-forging presses.

18 Claims, 4 Drawing Figures

ASSEMBLY FOR BLOWING OUT AND SPRAYING DIES IN FORGING PRESSES

FIELD OF THE INVENTION

The invention relates to a device for blowing out and spraying dies in forging presses, more particularly in drop-forging presses having automatic workpiece transport means such as a walking beam. The blowing and spraying device comprises arms or similar provided with nozzles, which arms are introduced or guided into the mould area of the forging press and guided back out of it.

BACKGROUND OF THE INVENTION

To guarantee the quality of the die-pressed parts and to cool, clean and lubricate the forging dies required for shaping, it is necessary to blow the surfaces of the molds free of forging scales, and to lubricate and cool them sufficiently. This is done in various ways. In hand-operated drop-forging presses, the molds are lubricated and blown out with a hand spraygun by the operator. The same can be done using a stationary nozzle system mounted in the upper and lower mold areas. It is also known to use pneumatically, electrically or hydraulically driven spraying arms located at either the rear or the side depending on the design of the individual drop forging press. Using hand operated presses, the operator actuates an appropriate switch at the end of the respective forging process and then carries out the blowing and spraying process.

When a drop-forging press has an automatic workpiece transport, the workpieces are transported from one work station to another within the tool area by using walking beams. There is no time gap between the working on various parts as when the forging operation is effected by hand. The workpiece transport is carried out continually within the mold area of the forging press. Using this type of transport system, the forging operation is carried out with each second forging station being occupied. That is, during the automatic procedure of the forging system, only each second forming station is occupied by a workpiece.

In this particular prior art arrangement, the blowing and spraying of the dies is carried out only when the dies are free of the workpiece and no pressing stroke is being effected. The time available for blowing and spraying the dies is extremely short and can be less than one second depending upon the number of strokes carried out by the automatic walking beam. When using electrically, pneumatically or hydraulically controlled spraying arms, such arms can be guided into the mold area only when the plunger of the forging press has stopped in its upper dead center. Thus, a significant portion of the already short length of time available for blowing and spraying is lost during the control and monitoring times of the forging press and transport operation.

PURPOSE OF THE INVENTION

A primary object of the invention is to provide a blowing and spraying assembly for the dies of a drop-forging press which can be coordinated into the whole structure of a drop-forging press and operated automatically in concert with a walking beam transport system. The blowing and spraying assembly of the present invention is simple in structure, reliable in operation and suitable for adaptation to a hand operated drop-forging press.

SUMMARY OF THE INVENTION

The blowing and spraying assembly made in accordance with this invention has a carrier means comprising spraying limbs which are coupled to a four-bar linkage arrangement. The linkage arrangement comprises two levers pivotally mounted to a support member and a carrier means having a nozzle system at the end thereof to project into the mold area of a forging press. One of the two levers is a drive lever connected to a drive mechanism. The carrier support member is fixedly secured with respect to the forging press. In one embodiment, the carrier support comprises a housing secured to the stator of the forging press.

The blowing and spraying assembly made in accordance with this invention permits the universal use of one and the same assembly in both a hand-operated drop-forging press and in automated drop-forging presses having a walking beam transport system used for moving the workpieces from one work station to another. The blowing and spraying nozzles located at the end of the carrier are mechanically coupled through the carrier to the hinged, linkage arrangement. When used with the automated drop forging press, the four-bar linkage arrangement is driven through a mechanism that is dependent upon the movement of the plunger of the forging press. In this type of operation, the drive lever of the four-bar linkage arrangement is designed as an elbow lever having one of its arms mechanically connected to the movable plunger mechanism of the forging press. The design of the four-bar linkage arrangement is such that it is easily changed to have a different kind of drive mechanism which does not derive its movement from the movement of the press plunger itself but provides its own drive mechanism. This latter arrangement is used in conjunction with hand operated forging presses. In either instance however, the position of the blowing and spraying assembly within the drop forging press remains the same. Storing and supplying the blowing and spraying operation through the assembly made in accordance with this invention is greatly simplified when compared to known prior art arrangements.

One of the particular features of the invention is the derivation of drive for the four-bar linkage arrangement from the movement of the press plunger. Such a drive mechanism acheives maximum possible delay times of the spraying assembly within the mold area and every second of available time is used for the die blowing and spraying process. With this embodiment of the invention, the spraying nozzles are located in the mold area of the press only when the press plunger is in its upper position. A high degree of operational safety is achieved within any additional expenditure uncontrolled because the direct plunger drive for the spraying and drive assembly guarantees that the assembly itself is at no time endangered by the initiated pressing stroke.

Another feature of the invention is the drive mechanism used to operate the four-bar linkage arrangement independently with respect to the press plunger. In this embodiment, the drive lever of the linkage arrangement is connected to a crank mechanism with a connecting rod. The crank mechanism may comprise a hydraulic rotary piston drive mechanism. Such a crank mechanism permits a sine-shaped speed course starting from the speed zero and ending in the mold area with the speed zero. This type of drive arrangement permits very rapid operation of the blowing and spraying assembly. Favorable conditions are therefore created at the same time for rapid work. Electrical or pneumatic drives can also be used for the crank mechanism rather than a hydraulic rotary piston drive.

When the drive for the four-bar linkage arrangement is derived from the movement of the press plunger, the drive lever which faces the pressing area of the forge press comprises an elbow lever with one if its arms coacting with the press plunger. The press plunger of the forging press includes a shoulder means which engages the outer end of the coacting arm of the elbow lever. In a specific embodiment, the shoulder means comprises a bracket which is mounted to the press plunger. The outer end of the coacting arm includes roller means which engages the bracket member. The drive lever is held under contact pressure in a direction toward the pressing area of the forging press. This contact pressure may be effected either by using a mechanical spring action or a contact pneumatic prestressing action.

Another feature of the invention is that the two levers of the four-bar linkage arrangement have different lengths. The drive lever is the longer of the two levers. With this type of relationship between the two levers, the spraying nozzles disposed at the end of the carrier means will not collide with a continually operating automatic walking beam transport mechanism when the blowing and spraying assembly of the invention is pivoted into the mold area of the pressing space.

Another feature of the invention is directed to the configuration of the carrier means on which the nozzle means are mounted. The carrier means may have a hollow box configuration to which is attached the spraying arms carrying the nozzles for blowing and spraying the molds in the pressing area of the forge press. The spraying arm carrying the nozzles is removably secured to the end of the hollow box carrier member. According to this feature of the invention, the spraying arm system can be easily suited to individual requirements on the basis of the size and number of the dies.

The carrier support means may comprise a housing to which the blowing and spraying assembly is attached. The housing can be arranged in a frame secured to the pressed stator. The frame is mounted to pivot about a pin or shaft mounting so that it may swing away from the stator of the press around the pin or shaft mounting. The other side of the frame is attached by fastening means such as a quick release device or other suitable lock mechanism. With this arrangement, the blowing and spraying assembly may be easily swung out of the press area when necessary such as for tool setting and maintenance work within the mold area of the forging press.

The frame carrying the housing to which the blowing and spraying assembly is attached may be secured to the stator of the forging press using retaining lugs. These lugs serve as adaptors according to the individual design of the drop forging press. The frame may be specially designed to effect the removal of spray mist resulting from blowing and spraying the dies within the mold area of the forging press. The lug adaptors can be designed to act as suction members. Thus, in a particular embodiment of the invention, the adaptors have the form of boxes and include appropriate suction apertures. When connected to a central suction device, the spray mist is sucked into the box formation of the retaining lugs through the suction apertures and thereby removed from the work area.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
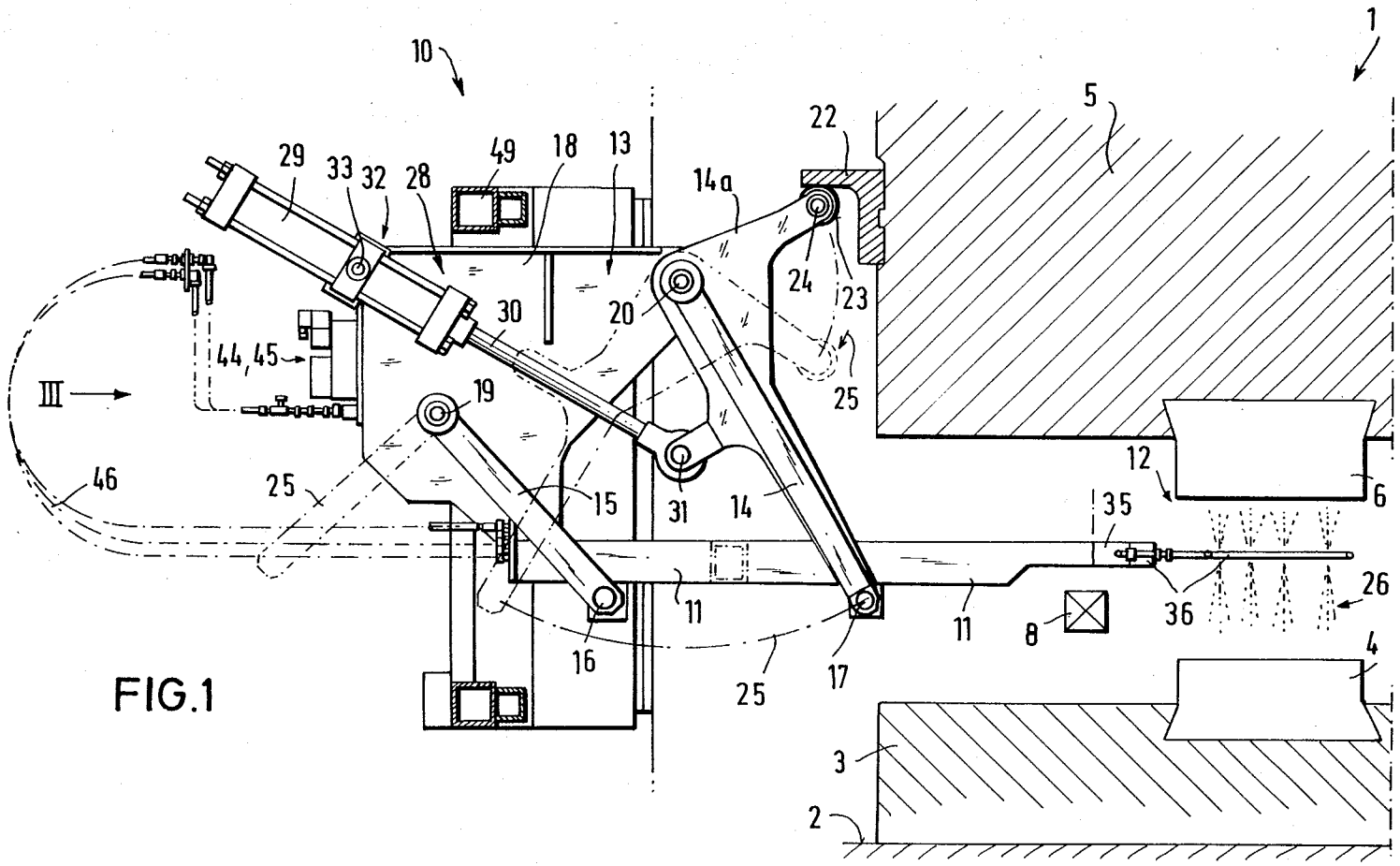
FIG. 1 is a schematic, longitudinal sectional view of a blowing and spraying device according to the invention driven by the plunger a drop-forging press having a walking beam.

The drop-forging press 1 (shown only schematically in outlines) comprises a mold holder 3 releasably connected to the table 2. The lower mold 4, e.g. a lower die, is mounted on holder 3. The plunger 5 carries the upper molds, e.g. upper die parts 6, and is driven and moved up and down in a known manner by a crank or eccentric disc mounted in the stator 7. A pair of walking beams 8 transports the workpiece from die to die. Beams 8 are operated by a transporting device (not shown) and are mounted on a framework standing in front of press 1. In automatic workpiece transport, the workpieces are grasped, lifted out of the dies, transported to the next die and lowered into it with the pair of walking beams, which are fitted with suitable grabs. The return transport path of the walking beam is carried out outside the molds.

The blowing and spraying device 10 is advantageously situated on the rear part of press 1 or respectively the press stator 7 and comprises a carrier 11 which carries a spray nozzle system at its front end. Carrier 11 is coupled to a four-bar linkage 13 having levers 14 and 15. A section of the carrier 11 at the same time forms one bar of the four-bar linkage 13. Levers 14 and 15 are hinged at one end to carrier 11 by axes 16 and 17. The other ends of levers 14 and 15 opposite the ends attached to carrier 11 are pivotably mounted to housing 18 at fixed axes 19 and 20. The drive for the four-bar linkage 13 acts on lever 14. Levers 14 and 15 have different lengths between the hinge points 16, 17, 19 and 20, the lever 14 advantageously being longer than the lever 15. This difference in the lever lengths serves to ensure that when swung out, the spraying system does not collide with the continually operating automatic pair of walking beams 8.

Figure 2:
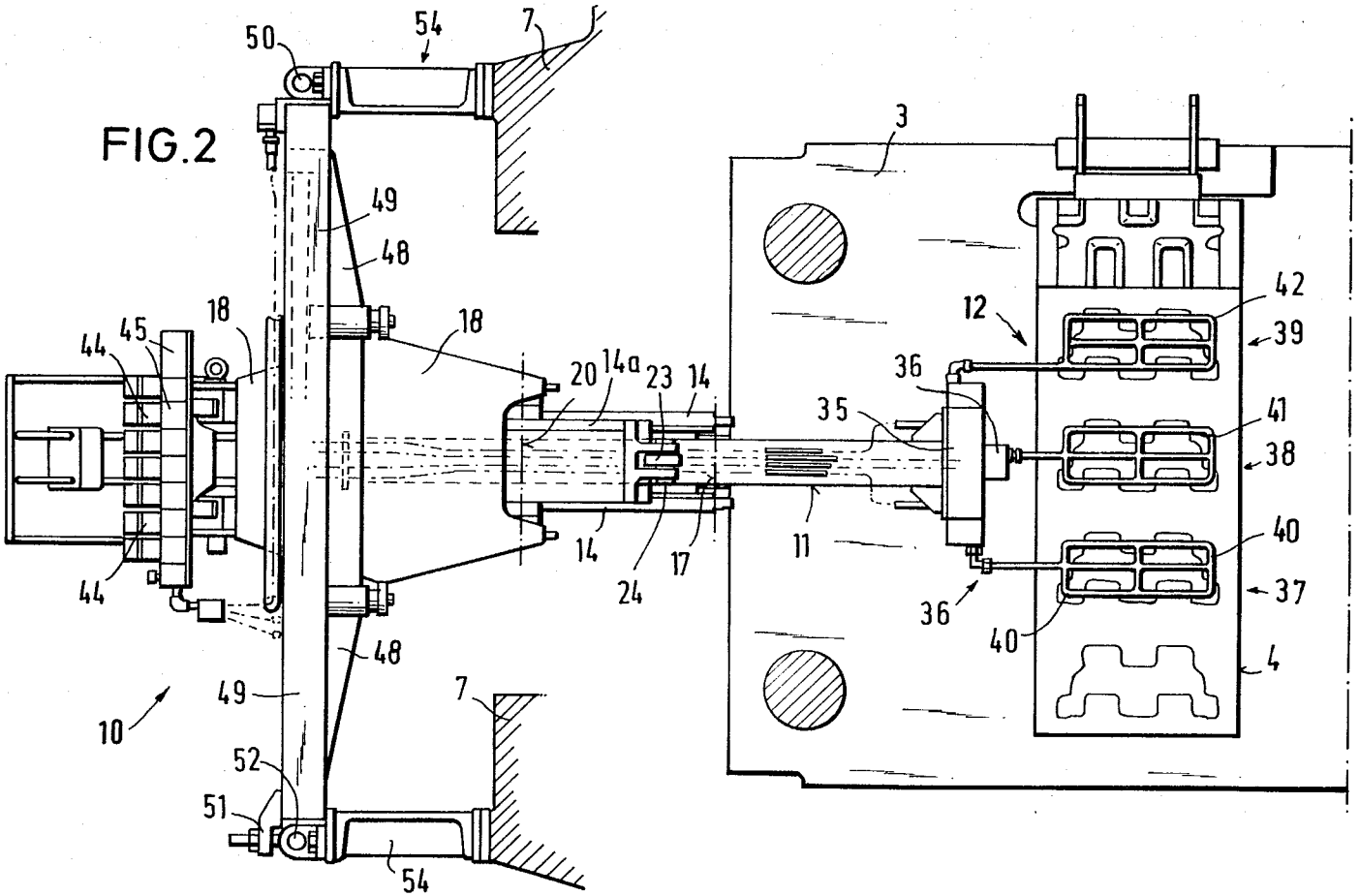
FIG. 2 is a plan view of the blowing and spraying device in FIG. 1.
Figure 3:
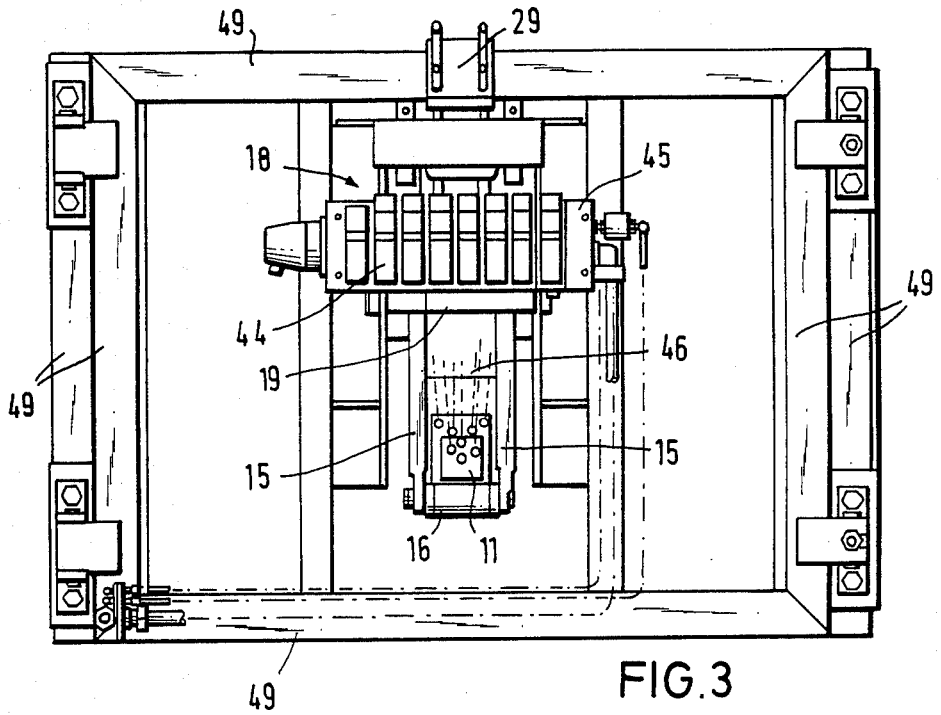
FIG. 3 is an elevational view of the blowing and spraying device according to the invention having a drive independent of the plunger.

In the embodiment of FIGS. 1 to 3, the drive for the four bar linkage 13 is derived from the movement of press plunger 5. Elbow lever 14 is a drive lever having arm 14*a* engaging shoulder 22 on a bracket secured at a suitable point to the plunger 5. Arm 14*a* of the drive lever 14 advantageously comprises a roller 23, rotatably mounted about axis 24. When press plunger 5 is moved from an upper position to a lower position, drive lever 14 and therefore the four-bar linkage 13 together with carrier 11 is pivoted back into the position 25 shown in the drawing with a dash-dotted line. The blowing and spraying device 12 can thereby only be in the mold area 25 when the press plunger 5 is in its upper position.

The four-bar linkage 13 is held under pressure in the direction toward press 1 to keep drive lever 14 abutting against bracket 22 on press plunger 5 with a form fit. While a mechanical spring action can be used, a pneumatic counter-retaining device 28 is used in this embodiment. Device 28 includes a pneumatic cylinder 29 having piston 30 hinged to drive lever 14 via hinge axis 31. Cylinder 29 is under a constant pneumatic pre-stress. A pressure reservoir (not shown) can follow the pneumatic cylinder 29. Such a reservoir has a specific volume relative to pneumatic cylinder 29 and is connected via a return valve to a pneumatic supply line. With this arrangement, additional compression is produced in the cylinder space of pneumatic cylinder 29 during the pressing stroke, and the counter-retaining force is thereby adapted to the drive forces occuring in the pressure stroke on drive lever 14. The arrangement has the further advantage that the addition of an unnecessarily large counter-retaining cylinder is avoided. The pneumatic cylinder 29 is rotatably mounted at axis 33 in a holder 32 arranged on housing 18.

In this embodiment, carrier 11 is a hollow-box carrier which is light-weight and rigid for dynamic loads. Flange 35 disposed on the front part of carrier 11 removably carries a spray nozzle system 36 fitting the mold area. As shown in the plan view, three dies 37, 38 and 39 must be blown out, cooled and lubricated. Allocated to each of these dies is a corresponding nozzle system 40, 41 and 42 which supplies compressed air or a compressed fluid and lubricating means. Spraying system 36 is arranged in the mold area 26 in its vertical position so that the workpiece transport can be carried out undisturbed by the walking beams 8 in the area below the spraying system. The occupation of the individual forging stations can be registered by a grab monitor installed in the walking beam. The spraying process is advantageously controlled electronically so that only those dies are blown and sprayed in which there is no workpiece.

Moreover, the necessary control valves 45 for the blowing air, spraying air and spraying agent are arranged on the housing 18, the valve block 44 being connected to the carrier 11 via hoses 46 by the shortest path.

Flange 48 on the rear side of housing 18 is inserted into a frame 49. Frame 49 together with the blowing and spraying device 10 is pivotably mounted on an axis 50 and can when necessary, e.g. for tool-setting and maintenance work be swung out of the pressing area 26. Quick release locks 51 enable rapid operation for swinging the blowing and spraying device 10 away from press 1. Quick-release locks 51 are pivotably mounted on axis 52.

Retaining lugs 54 secure frame 49 to the stator 7 of press 1 to enable the whole arrangement i.e. the frame 49 together with the blowing and spraying device 10, to be mounted on different types of drop-forging press. The retaining lugs 54 represent in this case appropriate adaptors. Suction devices are often provided on drop-forging presses to continually suck away the resulting spray mist from the operating point of the machine when the dies are being blown and sprayed. In most cases, the rear of the drop-forging press is suitable for this, which is also where the blowing and spraying device is often installed. Adaptors 54 have an advantageous box-shaped design and may be provided with appropriate suction apertures with adaptors 54 being connected to a central suction device. In this way, the suction device is advantageously connected to the securing means for the blowing and spraying device.

From time to time, the press plunger operates in single-stroke or single-direction operation. Then the blowing and spraying device stands outside the pressing area. In such an instance, pneumatic counter-retaining cylinder 29 is positioned via a suitable control valve to release the four-bar linkage 13 together with carrier 11 and spraying system 10 from shoulder 22 of plunger 5 when necessary and swing system 10 out of the pressing area.

Figure 4:
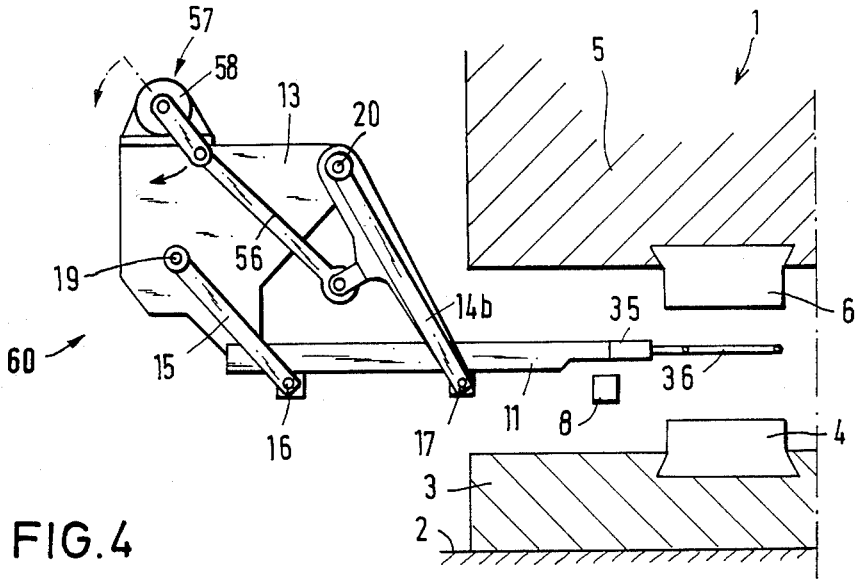
FIG. 4 is a side elevational view of another embodiment of a spraying device made in accordance with the invention.

FIG. 4 shows an embodiment in which the blowing and spraying device 60 is used in hand-operated drop-forging presses. The co-action of the press plunger 5 with a drive lever on the four-bar linkage 13 becomes unnecessary and therefore the press plunger 5 does not need to drive linkage 13. To achieve this, bracket 22 is removed. In this embodiment, a straight lever arm **14*b* is used for a drive lever. A connecting rod 56 with a crank mechanism 57 is pivotally attached to arm 14*b* and is used in place of the pneumatic counter-retaining cylinder 29 of the earlier embodiment. The hydraulic rotary piston motor 58 is advantageous because it permits a sine-shaped speed course for the blowing and spraying device 60** the speeds at the end points being zero in each case.

With crank mechanism 57, the blowing and spraying device 60 is in the initial position in the swung out position. When the operator has carried out the required number of forging operations, he initiates a spraying cycle with a switch, e.g. a foot-operated switch, which causes blowing and spraying of the dies when device 60 is swung in. Then, blowing and spraying device 60 is swung back out. As long as this cycle is incomplete, the pressing stroke of plunger 5 is blocked. The other parts of the blowing and spraying device 60 can remain unchanged.

While the assembly for blowing out and spraying dies in forging presses has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. An assembly for blowing and spraying dies in forging presses having a mold area and a press plunger, said assembly comprising:

(a) nozzle means mounted on carrier means to move into and out of the mold area of the forging press, (b) the carrier means being coupled to a four-bar linkage including two levers each having an end facing away from the carrier means being pivotably mounted to a support means, (c) one of the levers being connected to a drive means with the support means being fixedly secured with respect to the forging press, to define a drive lever mounted to move independent of the press plunger, and (d) said drive lever being connected via a connecting rod to a crank mechanism.

2. An assembly as defined in claim 1 wherein the crank mechanism is a hydraulic rotary piston drive.

3. An assembly for blowing and spraying dies in forging presses having a mold area and a forging press stator, said assembly comprising:

(a) nozzle means mounted on carrier means to move into and out of the mold area of the forging press, (b) the carrier means being coupled to a four-bar linkage including two levers each having an end facing away from the carrier means being pivotably mounted to a support means, (c) one of the levers being connected to a drive means with the support means being fixedly secured with respect to the forging press, (d) the support means including a housing arranged in a frame which is secured to the forging press stator, (e) said frame being pivotably mounted with pins or a shaft mounting to be swung away from the stator at one side thereof, and (f) retaining lugs secure the frame to the press stator, (g) the retaining lugs comprise boxes having apertures which are connected to a suction device.

4. An assembly for blowing and spraying dies in forging presses having a mold area, said assembly comprising;

(a) nozzle means mounted on carrier means to move into and out of the mold area of the forging press, (b) the carrier means being coupled to a four-bar linkage including two levers each having an end facing away from the carrier means being pivotably mounted to a support means, (c) one of the levers being connected to a drive means with the support means being fixedly secured with respect to the forging press, (d) the support means including a housing on its rear side, control valves for the blowing air, spraying air and the spraying agent, and (e) said control means being connected with hoses to the nozzle means on the carrier means.

5. An assembly for blowing and spraying dies in a forging press having a mold pressing area located between a mold holder and a press plunger, said assembly comprising:

(a) nozzle means mounted on a carrier member to move into and out of the mold pressing area of the forging press, (b) linkage means coupled to the carrier member for effecting the movement of the nozzle means into and out of said mold area, (c) the linkage means including two levers pivotally connected at one end thereof to the carrier member with the other ends of the levers facing away from the carrier member being pivotably mounted to a support means, (d) drive means connected to one of the levers, (e) said support means being fixedly secured with respect to the forging press, (f) means for operating the linkage means in dependence upon the movement of the press plunger so that movement of the linkage is derived from movement of the press plunger, (g) one of the two levers is a drive lever facing the mold pressing area of the press and is freely disposed with respect to the press plunger, and (h) said operating means including means located on the press plunger for freely engaging said drive lever to activate the linkage means for moving the nozzle means when the press plunger moves.

6. An assembly as defined in claim 5 wherein
the drive lever has an arm freely disposed with respect to the press plunger, and
the operating means includes shoulder means on the press plunger which engage said lever arm to cause the drive lever to move when the press plunger moves.

7. An assembly as defined in claim 6 wherein
the shoulder means comprises a bracket member mounted to the press plunger.

8. An assembly as defined in claim 7 wherein
the lever arm includes roller means disposed thereon to moveably contact the bracket member.

9. An assembly as defined in claim 6 wherein
the drive means includes pressure producing means causing the drive lever to be under pressure in the direction toward the pressing area of the press,
the pressure producing means includes a cylinder under pressure hinged to the drive lever.

10. An assembly as defined in claim 9 wherein
the cylinder is a pneumatic cylinder which is under a constant pneumatic pre-stress.

11. An assembly as defined in claim 6 wherein
a pressure reservoir with a specific volume relative to the pneumatic cylinder follows the cylinder, and
the pressure reservoir is connected via a return valve to a pneumatic source.

12. An assembly as defined in claim 5 wherein
the two levers are of different lengths, and the drive lever is longer than the other lever.

13. An assembly as defined in claim 5 wherein
the carrier member comprises a hollow-box carrier having a front flange part to which the nozzle means having a spraying arm system is removably secured.

14. An assembly as defined in claim 5 wherein
said support means includes a housing arranged in a frame which is secured to the forging press stator,
said frame being pivotably mounted with pins or a shaft mounting to be swung away from the press stator at one side thereof.

15. An assembly as defined in claim 14 wherein
the part of the frame opposite pivotably mounting means can be locked by quick-release or snap fastening means.

16. An assembly as defined in claim 14 wherein
retaining lugs serving as adapters are located between the frame and stator of the press,
the lugs comprise boxes having apertures and are connected to a suction device.

17. An assembly as defined in claim 5 wherein
said support means includes a housing on its rear side, control valves for the blowing air, spraying air and the spraying agent,
said control valves being connected to the spraying system of the carrier member with hoses.

18. An assembly as defined in claim 5 wherein
said drive means includes means urging the drive lever toward the mold pressing area, and
said operating means is effective to move the drive lever away from the mold pressing area when the press plunger moves toward the press mold holder.

* * * * *